United States Patent [19]

Woodling

[11] 4,198,194

[45] Apr. 15, 1980

[54] ROTARY PISTON MACHINE WITH WEAR SURFACE ON ROTARY VALVE MEMBER

[76] Inventor: George V. Woodling, 22077 Lake Rd., Rocky River, Ohio 44116

[21] Appl. No.: 913,321

[22] Filed: Jun. 7, 1978

[51] Int. Cl.[2] ..... F01C 1/02; F01C 21/12; F03C 3/00; F16K 3/26

[52] U.S. Cl. ..... 418/61 B; 418/179; 137/625.21

[58] Field of Search ..... 418/61 B, 179; 137/625.21

[56] References Cited

U.S. PATENT DOCUMENTS

| | | | |
|---|---|---|---|
| 1,055,781 | 3/1913 | Mitchell et al. | 137/625.21 |
| 3,531,225 | 9/1970 | Woodling | 418/61 B |
| 3,601,513 | 8/1971 | White, Jr. | 418/61 B |
| 3,704,968 | 12/1972 | Haupt | 418/179 |
| 3,887,309 | 6/1975 | Easton | 418/61 B |

*Primary Examiner*—John J. Vrablik
*Attorney, Agent, or Firm*—Woodling, Krost & Rust

[57] ABSTRACT

A rotary piston machine including an interface fluid valve mechanism comprising a flat blank surface, a rotary valve member, and a stationary valve member having a stationary valve face disposed substantially parallel to said flat blank surface and being axially spaced therefrom, said rotary valve member comprising a flange body and a hollow extension body axially extending therefrom, said flange body having a rotating valve face sealingly confronting said stationary valve face and defining therewith a commutating interface valve, said hollow extension body terminating in a hollow blank surface sealingly confronting said flat blank surface and defining therewith a blank interface seal, one of said blank surfaces comprising a master surface disposed to resist frictional wear during rotation of said rotary valve member and the other of said blank surfaces comprising a wear-in servant surface disposed to be less resistant to frictional wear than that of said master surface and being wearable thereby, said rotary valve member being subject to an axial fluid force in a direction tending to urge said rotating valve face towards said stationary valve face and tending to separate said master surface away from said wear-in servant surface, said wear-in servant surface being thereby protected from wearing out.

10 Claims, 7 Drawing Figures

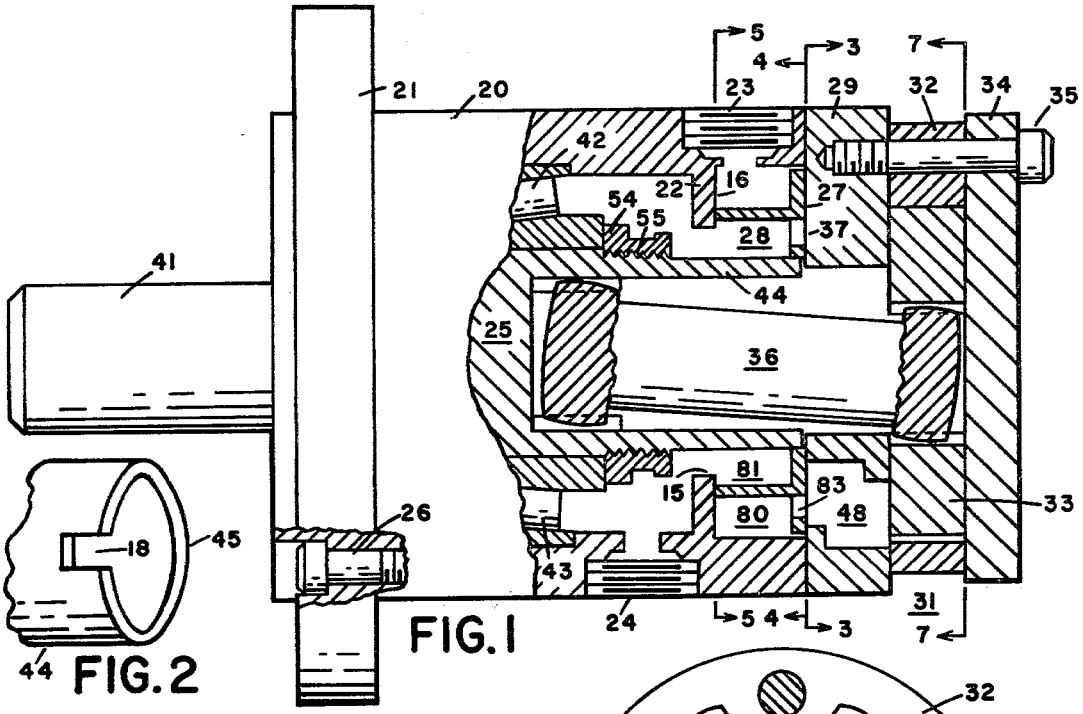
FIG. 1
FIG. 2
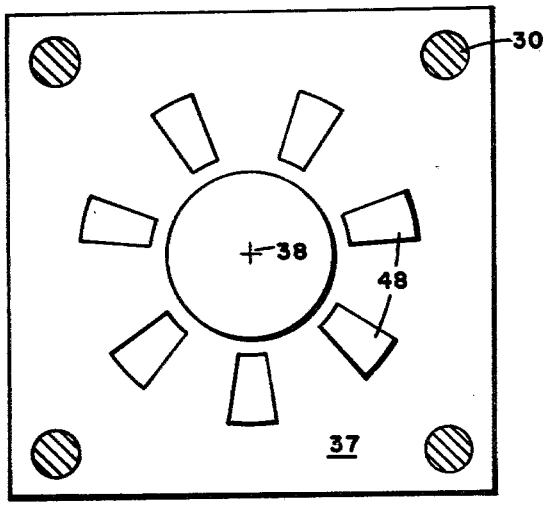
FIG. 3
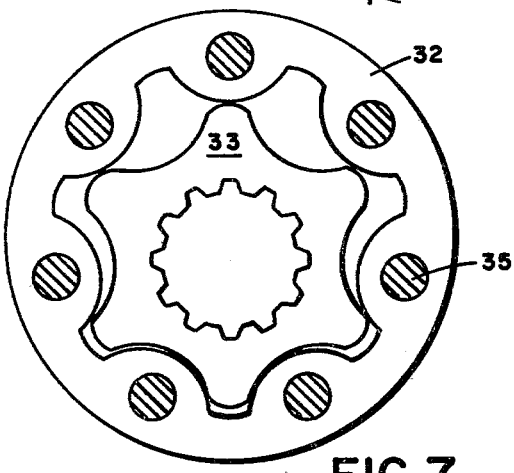
FIG. 7
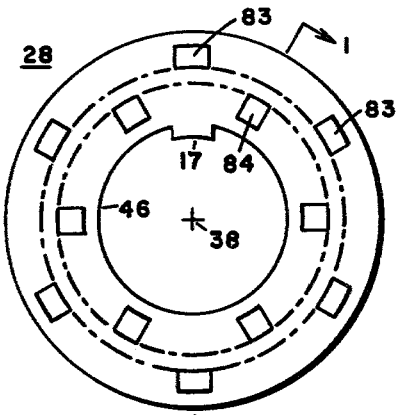
FIG. 4
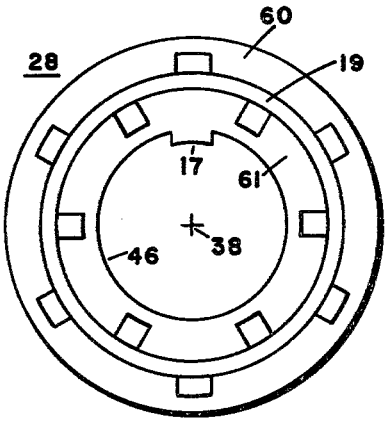
FIG. 5
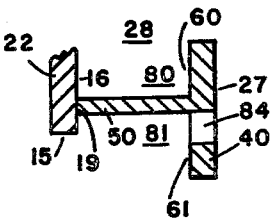
FIG. 6

ROTARY PISTON MACHINE WITH WEAR SURFACE ON ROTARY VALVE MEMBER

BACKGROUND OF THE INVENTION

An interface fluid valve mechanism for a rotary piston machine is subject to internal leakage between the metal-to-metal interface sealing surfaces at both ends of the rotary valve member. For successful operation, the seal clearance or tolerance factor between the metal interface sealing surfaces is required to be an extremely thin dimension and difficult to maintain on a production basis.

It is a case of matching very thin tolerances between the metal interface sealing surfaces and is aggravated by expansion due to heat of friction between the metal-to-metal matched surfaces. Should the seal clearance be matched too tightly, it may bring about a galling situation between the metal interface surfaces. The practice has been to lap these metal interface sealing surfaces to a fine tolerance, which is costly.

The ideal seal situation or tolerance factor is to allow a limited amount of leakage between the metal-to-metal matched sealing surfaces for needed lubrication to prevent heat expansion and galling, but to prevent all excessive leakage beyond that required for needed lubrication.

Besides reducing the volumetric efficiency of the rotary piston machine, excessive leakage may tend to impede the successful operation of the commutating porting of the rotary valve member. The timing sequence of the "make" and "break" of the registration of the commutative porting may become hampered if excessive leakage keeps right on leaking regardless of the registration.

The present invention, which comprises a commutating interface valve at one end of the rotary valve member and a flat blank interface seal at the other end, is disposed to allow a limited amount of leakage for needed lubrication. All excessive leakage is precluded. The flat blank interface seal comprises a master surface and a servant surface interfacing each other. The master surface comprises hard metal and is disposed to resist frictional wear. The servant surface comprises soft metal and is disposed to be less resistant to frictional wear than that of the hard metal. The soft metal surface and the hard metal surface are disposed, when assembled, to make a tight metal-to-metal fit against each other, allowing substantially no leakage. Upon relative rotation between the surfaces, the soft metal surface is disposed to wear in against the hard metal surface and may be referred to a servant wear-in surface.

The instant that needed lubrication begins to seep or flow between the hard and soft metal surfaces, as it will do upon relative rubbing action therebetween, the wear action then stops, with the result that the soft metal surface is disposed to wear in, but not wear out. The wear-in clearance space between the hard and soft metal surfaces incident to wear-in of the soft metal surface, at the time needed lubrication begins to flow between the rubbing surfaces, is a measure of the tolerance factor. From the standpoint of controlled leakage which provides for needed lubrication, the tolerance factor or wear-in seal clearance becomes ideal, in that it wears to what the situation calls for, and even accommodates for the viscosity or thickness of the hydraulic fluid used in the rotary piston machine. The wear-in effect is that the hard metal surface burnishes the soft metal surface and makes it smooth. The soft metal surface, before it is burnished, may comprise a turning machine cut finish.

The hard metal surface is urged by fluid pressure in a direction away from the soft metal surface, consequently the soft metal surface is protected from wearing out.

An object of my invention is to provide a wear-in seal clearance or tolerance factor which allows for needed lubrication but excludes excessive leakage.

Another object is to provide a seal clearance which is disposed to wear in but not wear out.

Another object is to urge the hard metal surface in a direction away from the soft metal surface to protect the soft metal surface from wearing out.

Another object is to burnish the soft metal surface and make it smooth.

Another object is wherein the soft metal surface, prior to becoming burnished, comprises a turning machine cut finish.

SUMMARY OF THE INVENTION

The invention constitutes a rotary piston machine having first and second fluid ports and including a stator and a rotor forming expandable and contractible piston chambers, a fluid valve mechanism for commutatively connecting said piston chambers to said fluid ports and including a flat blank surface, a rotary valve member having a longitudinal axis about which it may be rotated, a stationary valve member having a stationary valve face disposed substantially parallel to said flat blank surface and being axially spaced therefrom, said stationary valve member being positioned on said longitudinal axis between said rotary valve member and said piston chambers, and being provided with a plurality of fluid openings arranged in a ring about said longitudinal axis and in constant fluid communication with said piston chambers, said rotary valve member being disposed between said stationary valve face and said flat blank surface and comprising a flange body and a hollow extension body axially extending therefrom, said flange body having a rotating valve face sealingly confronting said stationary valve face and defining therewith a commutating interface valve, said hollow extension body terminating in a hollow blank surface sealingly confronting said flat blank surface and defining therewith a blank interface seal, valve actuating means interconnecting said rotary valve member and said rotor to rotate said rotary valve member at a speed the same as that of said rotor, said fluid valve mechanism further including an outer fluid valve chamber and an inner fluid valve chamber, said outer valve chamber encompassing said rotary valve member and being in constant fluid communication with said first fluid port, said inner valve chamber being within said rotary valve member and in constant fluid communication with said second fluid port, said outer and inner valve chambers being oppositely pressurized, whereby when one is pressurized the other is at exhaust pressure, said rotary valve member having a first series of commutating fluid passages extending from said outer fluid valve chamber to said rotating valve face and having a second series of commutating fluid passages extending from said inner fluid valve chamber to said rotating valve face, said fluid passages being disposed alternately with respect to each other and adapted to connect commutatively said outer and inner valve chambers to said fluid openings in said stationary valve face during rotation of said rotary valve member, said fluid passages in each series being one less in number than the number of fluid openings in said stationary valve face, said blank surfaces defining a small interface area therebetween, said rotating valve face and said stationary valve face defining a large interface area therebetween as compared to said small interface area, said rotating valve face and said stationary valve face having a hardness value substantially free from frictional wear, said flange body having an outer flange surface exposed to fluid pressure in said outer valve chamber and having an inner flange surface exposed to fluid pressure in said inner valve chamber, whereby said rotary valve member is subject to an axial fluid force in a direction tending to urge said rotating valve face towards said stationary valve face and tending to separate said hollow blank surface away from said flat blank surface, one of said blank surfaces comprising a master surface disposed to resist frictional wear during rotation of said rotary valve member and the other of said blank surfaces comprising a wear-in servant surface disposed to be less resistant to frictional wear than that of said master surface and being wearable thereby.

BRIEF DESCRIPTION OF THE DRAWINGS

Other objects and a fuller understanding of this invention may be had by referring to the following description and claims, taken in conjunction with the accompanying drawings, in which:

FIG. 1 is a partial, elongated sectional view of a rotary piston machine embodying the features of my invention, the section through the rotary valve being taken along the line 1—1 of FIG. 4;

FIG. 2 is a representation of a male shank provided on a terminal end portion of a hollow shaft adapted to slideably fit within a female socket in the rotary valve member and make a non-rotative connection therewith, the male shank being rotated 90 degrees from the position shown in FIG. 1;

FIG. 3 is a view of the front side of the stationary valve member, taken along the line 3—3 of FIG. 1;

FIG. 4 is a view of the front end of the rotary valve member, taken along the line 4—4 of FIG. 1;

FIG. 5 is a view of the back end of the rotary valve member, taken along the line 5—5 of FIG. 1; and FIG. 6 shows an enlarged fragmentary, cross-sectional view of the top half of the rotary valve member in FIG. 1, to facilitate additional reference numbers; and FIG. 7 is a view taken along the line 7—7 of FIG. 1 and shows the stator and rotor of a rotary piston machine.

DESCRIPTION OF THE PREFERRED EMBODIMENT

The rotary piston machine embodying my invention may preferably comprise a fluid motor but is not limited thereto.

With reference to the drawings, the rotary piston machine in which my invention may be incorporated comprises generally a main housing 20 having substantially a square cross-section. A mounting flange 21 may be secured to the lefthand end of the housing by means of suitable screws 26, one of which being shown. The housing is hollow from end-to-end and intermediate the ends of the housing there is provided an internal wall 22 having a central opening 15 and generally separating the hollow housing into a lefthand end compartment and a righthand end compartment. The internal wall has a flat blank surface 16.

Rotatively mounted in the lefthand end compartment is a main load shaft 25 having an axis substantially coinciding with the longitudinal axis of the rotary piston machine. The main shaft 25 comprises an enlarged internal portion having a reduced external portion 41 extending axially outwardly of the main housing through the mounting flange 21. The enlarged internal portion of the main shaft is supported preferably by tapered roller bearings 42 and 43 which provide end thrust as well as radial thrust. A lightening nut 54 which threadably engages male threads 55 secures the bearings 42 and 43 against axial movement upon the main shaft. The tightening nut 54 may be provided with a built-in locking feature to prevent loosening.

The righthand end compartment comprises a valve compartment having an open end against which a square stationary valve member 29 is mounted by means of screws 30. The stationary valve member 29 has a stationary valve face 37 disposed substantially parallel to the flat blank surface 16 and is axially spaced therefrom. In the valve compartment and between the stationary valve face 37 and the flat blank surface 16, there is mounted a rotary valve member 28 adapted to be rotated relative to the stationary valve face 37 for controlling the entrance of fluid to and the exit of fluid from a gerotor 31 comprising a stator 32 and a rotor 33. In operation, the stator 32 and the rotor 33 form expandable and contractible piston chambers. An end cap 34 encloses the stator 32 and the rotor 33, all being secured to the stationary valve member 29 by means of screws 35. Fluid is delivered to and from the housing 20 through a pair of fluid ports 23 and 24. An interconnecting wobble shaft 36 interconnects the rotary valve member 28 and the rotor 33, whereby the rotary valve member is rotated at the same speed as that of the rotor 33.

The bearings 42 and 43 constitute common bearing means for the main shaft 25 and the rotary valve member 28. The common bearing means directly supports the main shaft 25 and indirectly supports the rotary valve member 28 through extension drive means comprising a hollow shaft 44 integrally connected to the main shaft 25. The hollow shaft 44 extends axially through the central opening 15 in the internal wall 22 and then projects into the valve compartment to make a driving connection with the rotary valve member 28 for driving same. The hollow shaft 44 terminates with a male shank 45 which slideably fits within a female socket 46 provided in the rotary valve member 28, see FIG. 5. This connection comprises a non-rotative connection consisting of a tongue 17 fitting into an axial slot 18 and rotates the rotary valve member 28 upon rotation by the main shaft. This connection also provides slideable axial movement between the rotary valve member 28 and the hollow shaft 44 to accommodate for axial movement of the main shaft without interfering with the operation of the rotary valve member 28.

The stationary valve member 29 is positioned on a longitudinal axis 38 about which the rotary valve member rotates. It is disposed between the rotary valve member 28 and the gerotor 31 and is provided with a plurality of fluid openings 48 arranged in a ring about the axis 38 and in constant fluid communication with the piston chambers.

As illustrated in FIG. 6, the rotary valve member 28 comprises a flange body 40 and a hollow extension body 50 axially extending therefrom. The flange body 40 has a rotating valve face 27 sealingly confronting said stationary valve face 37 and defines therewith a commutating interface valve. The hollow extension body 50 terminates in a hollow blank surface 19 sealingly confronting said flat blank surface 16 and defines therewith a blank interface seal. The hollow blank surface 16 and the rotating valve face 27 have substantially the same hardness value.

The rotary valve member 28 defines an outer valve chamber 80 and an inner valve chamber 81. The outer valve chamber 80 encompasses the rotary valve member 28 and is in constant fluid communication with the fluid port 23. The inner valve chamber 81 is within the rotary valve member 28 and is in constant fluid communication with the fluid port 24 through the central opening 15 and around the hollow shaft 44.

The outer and inner valve chambers 80 and 81 are oppositely pressurized, whereby when one is pressurized the other is at exhaust pressure. The fluid thus tends to leak from one chamber to the other. This leakage is referred to as internal leakage and occurs between the commutating interface valve at one end of the rotary valve member 28 and between the blank interface seal at the other end of the rotary valve member. It is thus realized that the leakage problem is concerned specifically with the tolerance factor or seal clearance between the rotating valve face 27 and the stationary valve face 37 at one end of the rotary valve member 28, and between the hollow blank surface 19 and the flat blank surface 16 at the other end of the rotary valve member 28. The outer and inner fluid valve chambers 80 and 81 are thus sealingly separated from each other by these two sets of interface surfaces. The hollow blank surface 19 defines a circular interface area with the flat blank surface 16. The rotating valve face 27 defines a large interface area with the stationary valve face 37 as compared to the circular interface area. The rotating valve face 27 and the stationary valve face 37 preferably comprise metal disposed to resist frictional wear. Since the area and the resistance to frictional wear are large, the rotating valve face 27 and the stationary valve face 37 are substantially free from frictional wear.

As shown, the rotary alve member 28 has a first series of commutating fluid passages 83 extending from the outer fluid valve chamber 80 to the rotating valve face 27 and has a second series of commutating fluid valve passages 84 extending from the inner fluid valve chamber 81 to the rotating valve face 27. The fluid passages 83 and 84 are disposed alternately with respect to each other and are adapted to connect commutatively the outer and inner valve chamber 80 and 81 to the fluid openings 48 in the stationary valve face 37 during rotation of the rotary valve member 28. The fluid passages in each series are one less in number than the fluid openings 48 in the stationary valve face 37.

The flange body 40 has an outer flange surface 60 exposed to fluid pressure in the outer valve chamber 80 and has an inner flange surface 61 exposed to fluid pressure in the inner valve chamber 81, whereby in operation the rotary valve member 28 is subject to an axial fluid force in a direction tending to urge the rotating valve face 27 towards the stationary valve face 37 to reduce the internal leakage therebetween. This means that the timing sequence of the "make" and "break" of the registration of the commutative porting is free from being impeded, as would be the case if there was excessive leakage between these interface surfaces.

In accordance with an object of the present invention, the hollow blank surface 19 at the terminating end of the hollow extension body 50 comprises a master surface of hard metal disposed to resist frictional wear during rotation of the rotary valve member 28. The flat blank surface 16 against which the master face rotates comprises a wear-in servant surface of soft metal disposed to be less resistant to frictional wear than that of said master surface and being wearable thereby.

Upon assembly of the rotary piston machine, these hard and soft metal surfaces are disposed to make a tight metal-to-metal fit against each other, allowing substantially no leakage. Upon relative rotation between the surfaces, the soft metal surface is disposed to wear in against the hard metal surface. The wear-in action stops at the instant that needed lubrication begins to seep or flow between the hard and soft metal surfaces. The clearance space to which the soft metal wears in is a measure of the tolerance factor between the soft and hard metal surfaces. By nature, this tolerance factor becomes ideal, as it wears in to what the situation calls for, and even accommodates for the viscosity or thickness of the hydraulic fluid used in the rotary piston machine. In wearing-in, the hard metal surface burnishes the soft metal surface and makes it smooth. It is to be noted that the soft metal surface, upon being burnished, becomes somewhat hard itself for resisting further wear-in. The soft metal surface, before it is burnished, may comprise a regular turning machine cut finish which most expert hands would discard as being unsuitable for a seal surface. The soft metal surface is protected from wearing out, since the rotary valve member 28 is hydraulically urged, during operation, to draw the hard metal surface away from the soft metal surface. The tolerance factor always comes out ideal; namely, to what the situation calls for, regardless of production variations in the degree of the tightness of the metal-to-metal fit when initially assembled. Production-wise the degree of the initial fit is not critical, so long as there is some soft metal to wear in. The quality of the initial fit need not be held to such close tolerances so that required for lapping. A turning machine cut finish makes a very good base surface for the initial fit and subsequent burnishing. Besides, it is not so expensive as a lapped fit.

In the present invention, the flat blank surface 16 is firm in an axial direction and is not disposed to be axially constrainable. As is apparent, the present invention is completely free and independent of compression springs and other axially constrainable members adapted to urge the rotary valve face 27 against the stationary valve face 37 to reduce leakage. The wear-in tolerance factor makes the present invention ideal without resorting to springs or other compressible members. The present invention is also free from "O"-rings and gaskets.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A rotary piston machine having first and second fluid ports and including a stator and a rotor forming expandable and contractible piston chambers, a fluid valve mechanism for commutatively connecting said piston chambers to said fluid ports and including a flat blank surface, a rotary valve member having a longitudinal axis about which it may be rotated, a stationary valve member having a stationary valve face disposed substantially parallel to said flat blank surface and being axially spaced therefrom, said stationary valve member being positioned on said longitudinal axis between said rotary valve member and said piston chambers, and being provided with a plurality of fluid openings arranged in a ring about said longitudinal axis and in constant fluid communication with said piston chambers, said rotary valve member being disposed between said stationary valve face and said flat blank surface and comprising a flange body and a hollow extension body axially extending therefrom, said flange body having a rotating valve face sealingly confronting said stationary valve face and defining therewith a commutating interface valve, said hollow extension body terminating in a hollow blank surface sealingly confronting said flat blank surface and defining therewith a blank interface seal, valve actuating means interconnecting said rotary valve member and said rotor to rotate said rotary valve member at a speed the same as that of said rotor, said fluid valve mechanism further including an outer fluid valve chamber and an inner fluid valve chamber, said outer valve chamber encompassing said rotary valve member and being in constant fluid communication with said first fluid port, said inner valve chamber being within said rotary valve member and in constant fluid communication with said second fluid port, said outer and inner valve chambers being oppositely pressurized, whereby when one is pressurized the other is at exhaust pressure, said rotary valve member having a first series of commutating fluid passages extending from said outer fluid valve chamber to said rotating valve face and having a second series of commutating fluid passages extending from said inner fluid valve chamber to said rotating valve face, said fluid passages being disposed alternately with respect to each other and adapted to connect commutatively said outer and inner valve chambers to said fluid openings in said stationary valve face during rotation of said rotary valve member, said fluid passages in each series being one less in number than the number of fluid openings in said stationary valve face, said blank surfaces defining a small interface area therebetween, said rotating valve face and said stationary valve face defining a large interface area therebetween as compared to said small interface area, said rotating valve face and said stationary valve face having a hardness value substantially free from frictional wear, said flange body having an outer flange surface exposed to fluid pressure in said outer valve chamber and having an inner flange surface exposed to fluid pressure in said inner valve chamber, whereby said rotary valve member is subject to an axial fluid force in a direction tending to urge said rotating valve face towards said stationary valve face and tending to separate said hollow blank surface away from said flat blank surface, one of said blank surfaces comprising a master surface disposed to resist frictional wear during rotation of said rotary valve member and the other of said blank surfaces comprising a wear-in servant surface disposed to be less resistant to frictional wear than that of said master surface and being wearable thereby.

2. The structure of claim 1, including a housing member in which said rotary valve member is rotatable mounted, said wear-in servant surface being integral with said housing member.

3. The structure of claim 1, wherein said wear-in servant surface comprised an initial base finish made by a turning machine cutting tool.

4. The structure of claim 1, wherein said flat blank surface is firm in an axial direction and free from being axially constrainable.

5. The structure of claim 1, wherein said hollow blank surface and said flat blank surface define a circular interface area therebetween.

6. The structure of claim 1, wherein said outer flange surface is provided with a plurality of openings and defining said first series of commutating fluid passages and wherein said inner flange surface is provided with a plurality of openings and defining said second series of commutating fluid passages.

7. The structure of claim 1, wherein said master surface comprises hard metal, said wear-in servant surface comprising soft metal and being wearable by said hard metal.

8. The structure of claim 7, wherein said soft metal servant surface is burnishable by said hard metal surface.

9. The structure claim 7, wherein said servant soft metal surface has a burnished finish.

10. The structure of claim 7, wherein said hard metal surface and said rotating valve face have substantially the same hardness value.

* * * * *